United States Patent [19]

Herngren et al.

[11] Patent Number: 4,690,634

[45] Date of Patent: Sep. 1, 1987

[54] METHOD OF MEASURING DRY SUBSTANCE IN FLUE GASES

[75] Inventors: Torbjörn Herngren, Älvsjö; Jon Lofthus, Sollentuna, both of Sweden

[73] Assignee: Svenska Traforskningsinstitutet, Stockhold, Sweden

[21] Appl. No.: 865,848

[22] Filed: May 22, 1986

[30] Foreign Application Priority Data

May 31, 1985 [SE] Sweden ..... 8502697

[51] Int. Cl.[4] ..... F23C 5/00; F23M 3/02

[52] U.S. Cl. ..... 431/8; 122/379; 236/15 E; 431/76

[58] Field of Search ..... 431/76, 8, 12; 236/15 E; 122/379

[56] References Cited

U.S. PATENT DOCUMENTS

| | | | |
|---|---|---|---|
| 4,043,743 | 8/1977 | Seider | 431/76 |
| 4,078,880 | 3/1978 | Hunziker | 431/76 |
| 4,309,949 | 1/1982 | Rastogi | 431/76 X |
| 4,599,975 | 7/1986 | Reeve et al. | 122/379 |

*Primary Examiner*—Edward G. Favors

*Attorney, Agent, or Firm*—Burns, Doane, Swecker and Mathis

[57] ABSTRACT

The invention relates to a method of measuring dry substance in the flue gas in liquor recovery units in mills for the manufacture of papermaking pulp in order thereby to render it possible to control the operation of the unit. According to the invention, this is carried out in that the radiation emission caused at the combustion of fuel particles in the hearth of the unit above the fuel supply level is detected optically, and that the signals are used for indication and/or control of the operation of the unit.

20 Claims, 2 Drawing Figures

METHOD OF MEASURING DRY SUBSTANCE IN FLUE GASES

Figure 1:
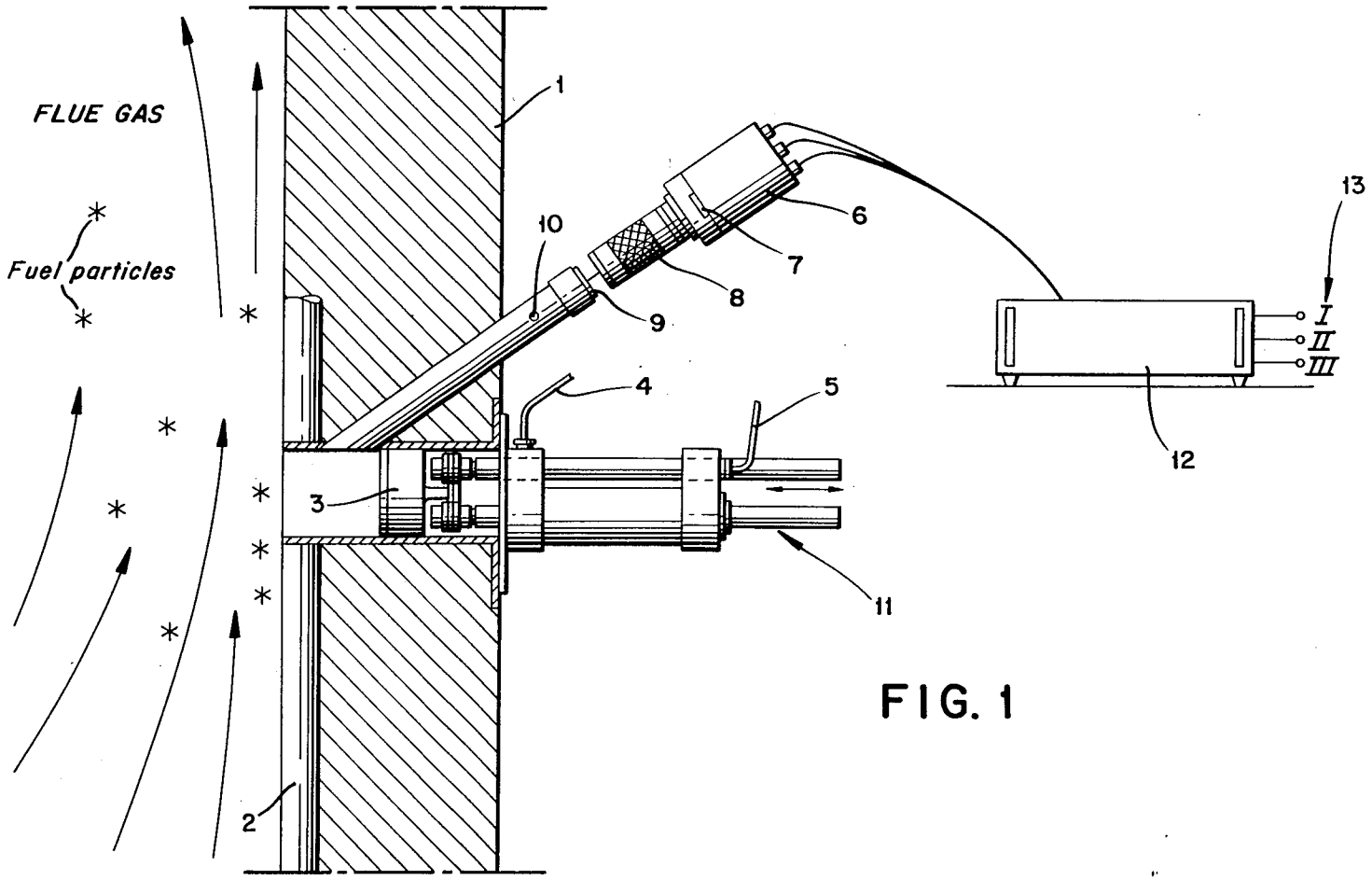

This invention relates to a method of measuring dry substance in flue gases, especially in liquor recovery units in mills for the manufacture of papermaking pulp.

Pulp mills for the manufacture of chemical papermaking pulp normally include a liquor recovery unit. Such a unit in a pulp mill is the process unit, which requires the greatest amount of capital. In many cases, therefore, this unit limits the production. It is important, therefore, that the liquor recovery unit has high capacity and accessibility. The present invention is a method of measuring dry substance in flue gases, which is of great importance for the accessibility of the soda recovery boiler.

The liquor recovery unit consists of an incinerator with a steam boiler connected thereto. A typical modern unit of this kind has a bottom area of about 100 $m^2$ and a height of about 50 m. The walls and bottom of the incinerator consist of tightly placed steel tubes. The tubes are connected to the water dome and, respectively, steam dome of a steam boiler and constitute portion of the heating surface.

Through ports located about the circumference of the incinerator, normally on three different levels, combustion air is injected into the incinerator. After the combustion process has been started, the process continues assisted by the supplied combustion air, whereby the organic substance content of the liquor is combusted and the combustion gases pass upward through the incinerator and through the tube system of the steam boiler where the gases give off their heat content to the feed water. The water is caused to boil and generates steam.

The content of inorganic chemicals of the liquor melts and is collected in a so-called bed on the bottom of the incinerator. The bed consists of inorganic chemicals and a carbon framework originating from the organic content of the liquor. The regeneration of the chemicals implies a.o. the reduction of sulphur contained therein. The regenerated chemicals are removed in the form of molten mass through grooves out of the incinerator.

In the hearth great amounts of dust are formed which follow along with the flue gases and partially adhere on the heat surfaces of the boiler. The dusts substantially contain sodium sulphate and sodium carbonate, but can also include other components to a varying extent. At disturbances in the air supply or at high incinerator load usually more or less uncombusted liquor particles follow along with the gas flow. Such particles develop coats on the heat surfaces which are removed only with great difficulty. Also, some of these particles, moreover, are combusted in connection to the heat surfaces and thereby give rise to a temperature which is too high in connection to the heat surface. Due to this high temperature, other dust (for example sodium sulphate) remains sintered on the heat surfaces, and its removal is very difficult.

For maintaining clean heat surfaces, liquor recovery units are normally provided with means for cleaning the heat surfaces. Such soot removal apparatuses normally consist of lance pipes, through which steam is injected while the lance pipe is being moved through the boiler. A modern boiler is equipped with about seventy such soot removers. Even with these cleaning means it is often necessary to stop the production for cleaning.

Such a cleaning stop often involves a loss of production for about 24 hours, which is very expensive.

The different soot removers normally are operated according to a pre-determined program that is there is little consideration given to the present amount of soil on the heat surfaces at a certain time.

The measuring according to the invention has the object of making it possible to predict coats formed on the heat surfaces, to control the size of the fuel drops, to control the distribution of the fuel drops in the incinerator and/or to control the intensity of the removal of soot from the heat surfaces of the incinerator.

Heavily sooted coats on heat exchanger surfaces, especially in steam superheaters and in tube sets, are a troublesome problem in liquor recovery units at the manufacture of papermaking pulp, so-called soda recovery boilers. Such coats reduce the capacity and availability of the soda recovery boiler and thereby limit the production of the entire pulp mill.

Serious coats are caused by so-called direct overbearing of liquor. That is, coats result when atomized liquor is taken along by the gas flow and is combusted either partially or entirely high up in the hearth. When this happens, sparks arise by the combustion of small particles, which takes place on levels where normally no burning particles are to exist. By detecting the spark formation the existence of overbearing can be measured.

At the method according to the invention the radiation emission arising at the combustion of fuel particles in the hearth above the fuel supply level is detected optically, and the signals received are used for indication and/or control of the incinerator operation.

The method can be realized by different techniques. One method is apparent from the embodiment described below.

The signals received from the measuring instrument can be used, for example, for indication and warning to the operator that measures are to be taken, for automatic adjustment, for example, of spray elevation, liquor pressure and/or liquor temperature, and as (part the) criterium for optimizing the setting of the boiler operation.

Figure 2:
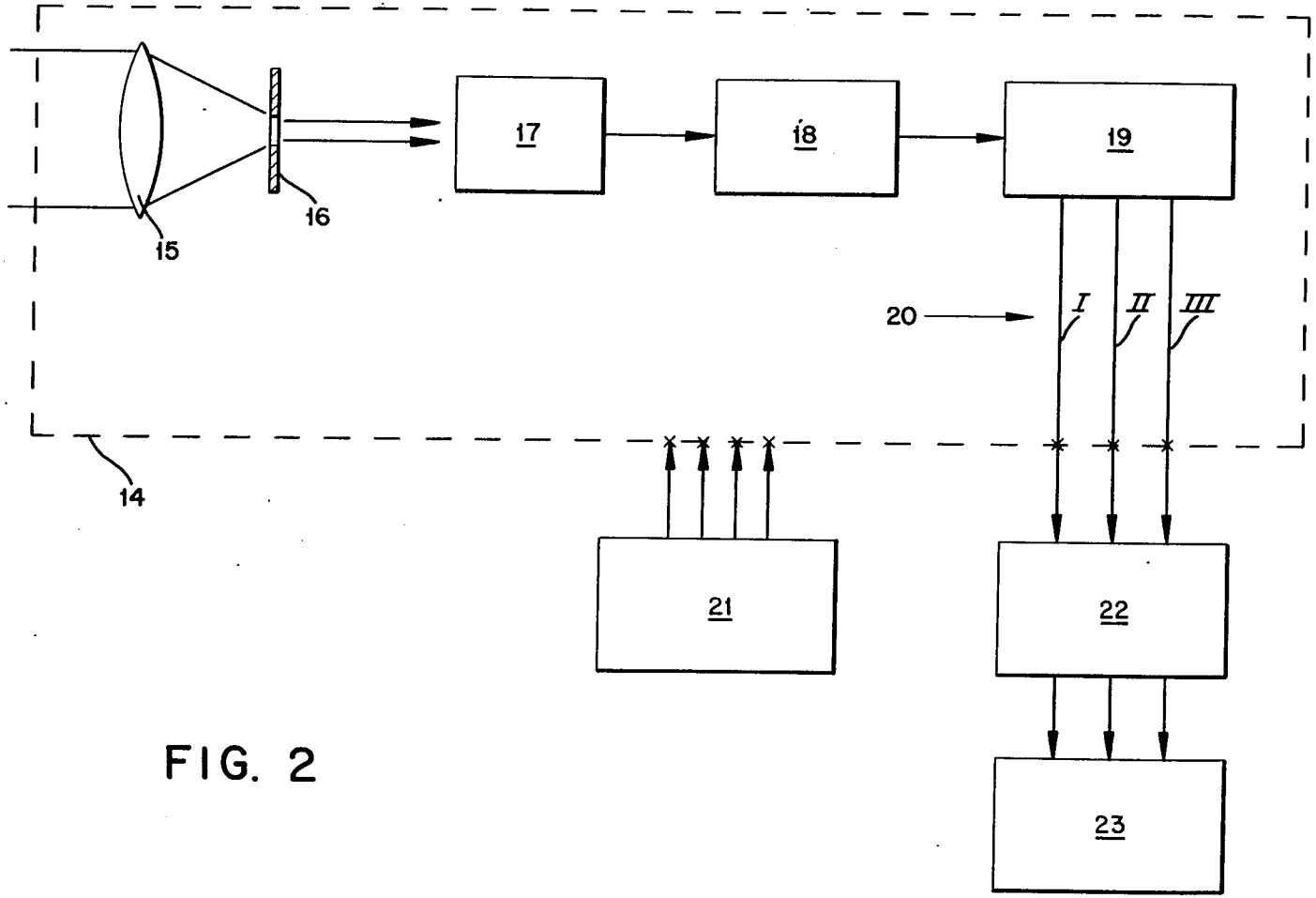

The invention is described in greater detail in the following by way of an embodiment thereof, and with reference to the accompanying drawings, in which FIG. 1 shows an arrangement for measuring dry substance according to the invention, and FIG. 2 is a block diagram of the method according to the invention.

In FIG. 1 a portion of the wall 1 of a liquor recovery unit is shown which is provided with water-cooled tubes 2. Arrows indicate how the flue gases sweep along the wall and also the spark formation arising at the combustion of particles of dry substance. In the wall, a hole is located into which an automatic cleaning device 11 is inserted, the cleaning piston 3 of which is driven by compressed air through the conduits 4 and 5. The cleaning device is of conventional design and not critical to the present invention. For detecting the spark formation in the wall of the unit, an inclined sleeve is provided which opens into the space for the cleaning piston 3 and is provided with a scavenging air connection 10 the supply of air to prevent coats on the protective glass 9 in the tube up to the measuring equipment. The reference numeral 8 indicates an optical lens system comprising a lens, by which the spark formation is reproduced on a detector 7. The detector of the embodiment shown is a so-called linear array consisting of 1024 diodes arranged in rows. The measuring housing 6 comprises the detector and electronics for driving the detector and for handling the signals from same. The measuring housing is connected by cables to an electronic unit 12, which comprises voltage supply units for the detector as well as other electronics and also comprises electronics for continuously counting the pulses in different classes received from the sensor unit. The electronic unit further comprises means for adaptation to the process, which according to the embodiment shown implies conversion from digital to analogue form of the signals and exhibitions of outputs of the analogue signals received. The unit 12 further is provided with status indications in the form of light emitting diodes, which indicate error, on, off, etc. By reference numerals 13 the outputs are symbolized which are used for passing the signals to a process computer 23, as shown in greater detail in FIG. 2.

In FIG. 2, the equipment comprised in the measuring housing 6 is marked by the dashed line 14. Reference number 15 designates the optical lens 8 according to FIG. 1, and 16 designates the optical detector 7 according to FIG. 1. The reference numeral 17 designates a drive card, i.e. an electronic card for driving the linear optical detector. From the card, the detector is provided with feed voltages and clock signals. The video signal received from the detector, is amplified on the card. The electronic card 18 is used for comparing the amplitude of the video signal or optical signal with a threshold value. The threshold value follows changes in intensity of the background radiation and is used so that only signal tops exceeding the threshold value are registered. On the electronic card 19, the pulse widths of the signals received are compared with, in the present case, two adjustable limits which yields a classification into three size classes. According to this embodiment two limits are sufficient, because the total extension of the detector in question, i.e. 1024 dots, decides the upper limit, and the width 0 is the lower limit. When in the unit 19 a pulse with a certain width has been detected, an electric signal is sent on corresponding outputs, as shown at 20, i.e. outputs I,II and III. The voltage unit 21 provides the device with feed voltage that is it supplies the electronic and detector comprised in the measuring housing with voltage +5 V, +15 V, −15 V and an 0-level (earth). By means of the calculator and process adaptation unit 22, the pulses generated in the unit 19 are counted on the output in question during a certain time. According to the present embodiment, a counting time of 10 minutes was used. During this time the unit counts the number of detected pulses within each size class. The totals obtained in the respective class are converted to an analogue current signal (4–20 mA), which are transferred and thereafter fed out from the unit 22. The unit 23 in FIG. 2 relates to a process computer according to the embodiment described. In other embodiments this designation can relate to indication equipment in a control room or control equipment for controlling the process.

The economical consequences of overbearing of liquor and coats/cloggings are very substantial. Production losses of thousands of tons per year in one single mill are not unusual. The problem has long been known, but no solution has been proposed before. The present invention relates to a method of measuring the occurrence of more or less uncombusted liquor particles in the flue gas in order to render it possible to predict and by means of adjusting steps to avoid, serious coats. The invention, of course, is not restricted to the embodiment described, but can be varied within the scope of the inventive idea.

We claim:

1. A method of measuring dry substance in the flue gas in liquor recovery units in mills for the manufacture of papermaking pulp and thereby render it possible to predict coats on heat surfaces, control of the size of fuel drops, control of the distribution of the fuel drops in the incinerator and/or control of the intensity of cleaning the heat surfaces of the boiler from soot, wherein radiation emitted from the combustion of fuel particles in the hearth of the liquor recovery unit above the fuel supply level is detected optically in the combustion chamber, the number of pulses of the signal received from the detection is determined and used as a measure of the number of fuel particles, and the signal is used for an indication and/or control of the operation of the unit.

2. A method as defined in claim 1 wherein the amplitude and pulse width of the signals received from the detection are determined and used as a measure of the size of the fuel particles, and the signals are used for indication and/or control of the operation of the unit.

3. A method as defined in claim 2, wherein the ampltiude of the signal received from the optical detection is compared with a pre-determined threshold value for registering only such signals which exceed a certain value.

4. A method as defined in claim 3, wherein the threshold value is dynamically changed so as to be in a certain relation to the total radiation intensity detected.

5. A method as defined in claim 1, wherein the pulse width of the signals received from the optical detection is compared with one or several pre-determined adjustable limit values for classifying the signals in classes corresponding to the size distribution of the fuel particles, and the signals thus classified after particle size are counted and registered during a certain time.

6. A method as defined in claim 1, wherein the signals are used for controlling the injection of fuel into the incinerator.

7. A method as defined in claim 1, wherein the signals are used for controlling the size of the fuel drops at the injection into the incinerator.

8. A method as defined in claim 1 for controlling the distribution of the fuel drops in the incinerator, wherein the signals are used for controlling the direction of the fuel nozzles in the hearth.

9. A method as defined in claim 1, wherein the signals are used from controlling the frequency and/or intensity of cleaning the heat surfaces from soot.

10. A method as defined in claim 2, characterized in, that the pulse width of the signals received from the optical detection is compared with one or several predetermined adjustable limit value for classifying the signals in classes corresponding to the size distribution of the fuel particles, and that the signals thus classified after particle size are counted and registered during a certain time.

11. A method as defined in claim 3, characterized in, that the pulse width of the signals received from the optical detection is compared with one or several predetermined adjustable limit value for classifying the signals in classes corresponding to the size distribution of the fuel particles, and that the signals thus classified after particle size are counted and registered during a certain time.

12. A method as defined in claim 2, characterized in, that the signals are used for controlling the injection of fuel into the incinerator.

13. A method as defined in claim 3, characterized in, that the signals are used for controlling the injection of fuel into the incinerator.

14. A method as defined in claim 4, characterized, in that the signals are used for controlling the injection of fuel into the incinerator.

15. A method as defined in claim 5, characterized in, that the signals are used for controlling the injection of fuel into the incinerator.

16. A method as defined in claim 2, characterized in, that the signals are used for controlling the size of the fuel drops at the injection into the incinerator.

17. A method as defined in claim 3, characterized in, that the signals are used for controlling the size of the fuel drops at the injection into the incinerator.

18. A method as defined in claim 4, characterized in, that the signals are used for controlling the size of the fuel drops at the injection into the incinerator.

19. A method as defined in claim 5, characterized in, that the signals are used for controlling the size of the fuel drops at the injection into the incinerator.

20. A method as defined in claim 6, characterized in, that the signals are used for controlling the size of the fuel drops at the injection into the incinerate.

* * * * *